US005202534A

United States Patent [19]

Tamiya et al.

[11] Patent Number: 5,202,534

[45] Date of Patent: Apr. 13, 1993

[54] DEVELOPING APPARATUS USING A LIQUID DEVELOPER AND HAVING A SYSTEM FOR CLEANING THE DEVELOPMENT REGION WITH A VACUUM PRESSURE

[75] Inventors: Yoshiumi Tamiya, Yokohama; Seiichi Miyakawa, Nagareyama; Kazuaki Iizuka, Tokyo; Kenichi Shimizu, Kawasaki; Shigeru Suzuki; Kiyoshi Ohshima, both of Yokohama; Tadahiro Suzuki, Kawasaki, all of Japan

[73] Assignee: Ricoh Company, Ltd., Tokyo, Japan

[21] Appl. No.: 779,257

[22] Filed: Oct. 18, 1991

[30] Foreign Application Priority Data

Dec. 16, 1990 [JP] Japan ..... 2-411152

[51] Int. Cl.[5] ..... G03G 15/10

[52] U.S. Cl. ..... 118/660; 355/206; 355/256; 355/264

[58] Field of Search ..... 355/256, 206, 264; 118/659, 660

[56] References Cited

U.S. PATENT DOCUMENTS 3,901,188 8/1975 Eberlein ..... 355/256 X
4,563,080 1/1986 Ottley ..... 118/659 X
5,016,036 5/1991 Nishikawa ..... 354/318
5,023,665 6/1991 Gundlach ..... 355/256
5,073,798 12/1991 Shirakura et al. ..... 118/659

FOREIGN PATENT DOCUMENTS 0033778 2/1991 Japan ..... 118/660

*Primary Examiner*—A. T. Grimley
*Assistant Examiner*—J. E. Barlow, Jr.
*Attorney, Agent, or Firm*—Oblon, Spivak, McClelland, Maier & Neustadt

[57] ABSTRACT

A developing apparatus using a liquid developer and a developing head located to face a path along which a recording medium carrying, for example, an electrostatic latent image thereon is transported. A groove is formed in the surface of the head that faces the transport path. After development, the liquid remaining at the corner defined by the upper inner portion of the groove and the medium is rapidly collected to allow a minimum of smear to occur on the part of the medium which will be transported later. When the transport of the medium should be interrupted during development due to, for example, a jam, the liquid in the groove is collected to prevent a great amount of liquid which would smear a drive roller and other transport members from being transferred from the head to the medium.

7 Claims, 8 Drawing Sheets

DEVELOPING APPARATUS USING A LIQUID DEVELOPER AND HAVING A SYSTEM FOR CLEANING THE DEVELOPMENT REGION WITH A VACUUM PRESSURE

BACKGROUND OF THE INVENTION

The present invention relates to a developing apparatus using a liquid developer and applicable to image forming equipment implemented with an electrophotographic, electrostatic or Similar system such as a copier, facsimile apparatus or printer.

One of conventional developing apparatuses of the type described has a developing head which is formed with a groove on the surface thereof facing a medium transport path, as disclosed in, for example, Japanese Patent Laid-Open Publication Nos. 179477/1986 and 185569/1989. The groove extends in the widthwise direction of, for example, an electrophotographic recording medium which is transported along the transport path. The apparatus develops a latent image electrostatically formed on the medium by filling the groove with a liquid developer. While the open end of the groove is closed by the medium, a pump motor or similar vacuum generating means is driven to suck the medium onto the surface of the head. After the development, the supply of the liquid to the groove is stopped, and the liquid in the groove is returned to a reservoir.

However, when the supply of the liquid to the groove is simply interrupted to return the liquid in the groove to the reservoir by gravity, the liquid remains in the form of a meniscus at the corner defined by the upper inner portion of the groove and the medium. As the medium is transported in such a condition, the remaining liquid is transferred from the head to the medium to smear the latter. When the medium is, for example, an electrostatic recording medium, smeared part thereof has to be simply discarded. Assume a color developing apparatus having a plurality of developing heads each being supplied with a liquid developer of particular color and moving particular one of the heads to a developing position where it faces a medium transport path. In such an apparatus, a recording medium is repetitively moved back and forth to opposite sides of the developing position. This brings about a problem that when the head located at the developing position is retracted to a standby position with the liquid remaining at the above-mentioned corner thereof, the liquid is apt to dry and solidify there and, therefore, apt to smear the medium when moved again to the developing position later. The developer deposited on the medium would smear means for transporting the medium. To eliminate this problem, the medium may be transported before the head having developed an image is retracted to the standby position, causing the remaining liquid to deposit on the medium. This, however, not only wastes the medium but also increases the width over which the medium has to be transported and thereby increases the developing time. Moreover, when the transport of the medium is interrupted while the development of a latent image by the developing head is under way due to a jam or similar cause, simply deactivating the vacuum generating means fails to remove all the liquid remaining on the head. This liquid is likely to deposit in a great amount on the medium and to smear the operator's hands and cloths as well as the medium transporting means.

SUMMARY OF THE INVENTION

It is, therefore, an object of the present invention to provide a developing apparatus capable of efficiently removing a liquid developer remaining at the corner defined by the upper inner portion of a groove and a recording medium when the liquid is returned from the groove to a reservoir after development.

It is another object of the present invention to provide a developing apparatus which prevents a liquid developer from remaining on a developing head thereof when an electrostatic recording medium has jammed a path during development.

It is another object of the present invention to provide a developing apparatus applicable to image forming equipment and using a liquid developer.

A developing apparatus for developing a latent image formed on a recording medium by a liquid developer fed to a groove formed in the surface of a developing head which faces a medium transport path and extending in the widthwise direction of the medium of the present invention comprises a reservoir storing the developer liquid, a feed path for feeding the liquid developer from the reservoir to the groove, a return path for returning the liquid developer from the groove to the reservoir, a vacuum source disposed in the return path for generating vacuum in the groove, a valve for selectively blocking or unblocking the feed path, a valve control for controlling the valve, and a vacuum control for controlling the vacuum source. After development, the vacuum control continuously drives the vacuum source over a predetermined period of time after the valve control has operated the valve to block the feed path.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 6:
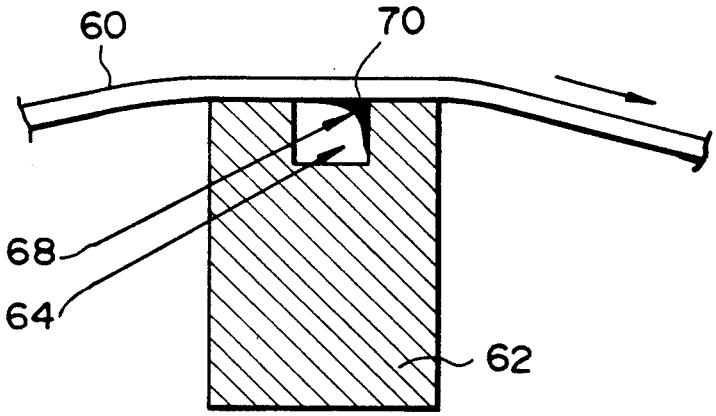
FIG. 6 is a section of a developing head included in a conventional developing apparatus.
Figure 7:
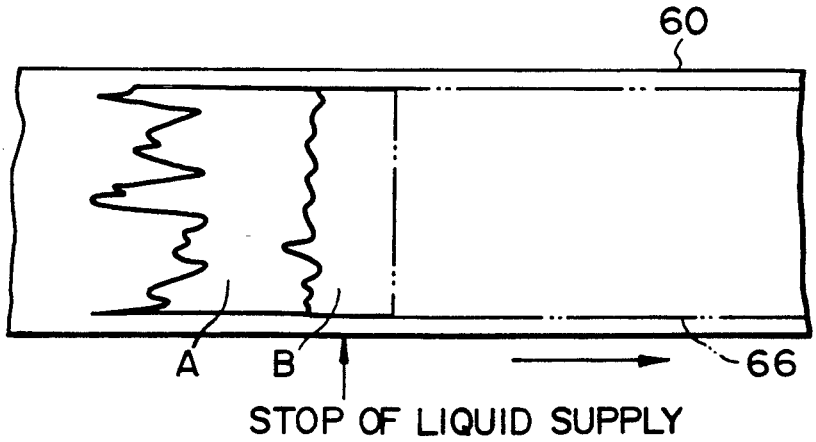
FIG. 7 shows an electrostatic recording medium having suffered from smears.

To better understand the present invention, a brief reference will be made to a prior art developing apparatus of the type to which present invention pertains, shown in FIGS. 6 and 7. As shown, the developing apparatus has a developing head 62 located on a transport path along which an electrostatic or similar recording medium 60 is transported. A groove 64 is formed in the surface of the head 62 which faces the medium 60. A liquid developer is fed to the groove 64 to develop an electrostatic latent image or similar image 66 formed on the medium 60. The medium 60 is urged against the head 62 by suction during the transport. After the development, the supply of liquid developer to the groove 64 is stopped, and the liquid in the groove 64 is returned to a reservoir by gravity. A problem with such an apparatus is that the liquid forms a meniscus 70 and remains at a corner 68 defined by the upper inner portion of the groove 64 and the medium 60, smearing the medium 60. When the medium 60 is implemented as an electrostatic recording medium, the smeared portion thereof cannot be used to form an image and is simply discarded.

Figure 1:
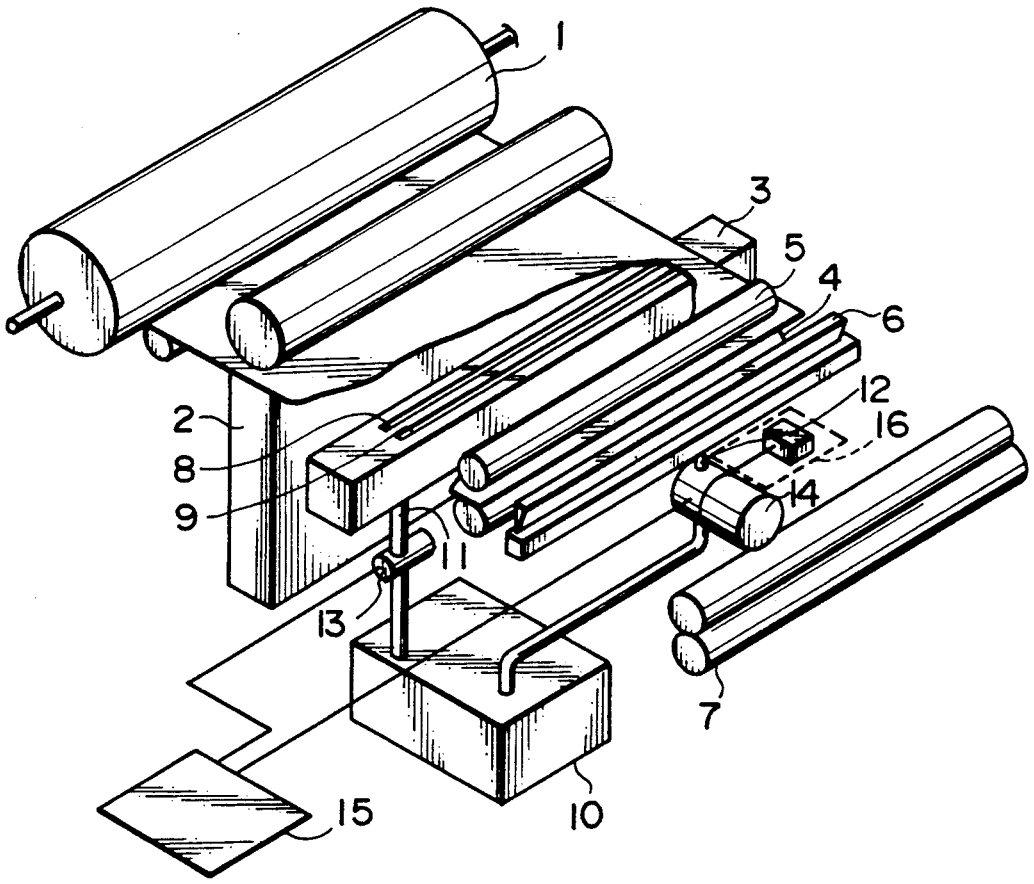
FIG. 1 is a perspective view showing the general construction of electrostatic image forming equipment which incorporates a developing apparatus embodying the present invention.

FIG. 1 shows electrostatic image forming equipment which incorporates a developing apparatus embodying the present invention. As shown, the equipment has an electrostatic recording medium is rolled on a shaft 1. The medium is paid out from the roll, extended over a recording head 2 and a developing head 3, and nipped by a drive roller 4 and a pinch roller 5 at the end thereof. In this condition, the equipment is ready to start on an image forming operation. As the drive roller 4 starts rotating to feed the medium, the recording head 2 electrostatically forms a latent image on the medium, and then the developing head 3 develops the latent image. Just before the leading edge of the developed image passes a cutter 6, the cutter 6 is driven to cut off the excessive portion of the medium that precedes the leading edge of the image. Just after the trailing edge of the image has passed the cutter 6, the rotation of the drive roller 4 is stopped while the cutter 6 is driven again to cut the medium. Only a discharge roller pair 7 is rotated to discharge the cut length of medium, i.e., a sheet to a tray, not shown.

Figure 2A:
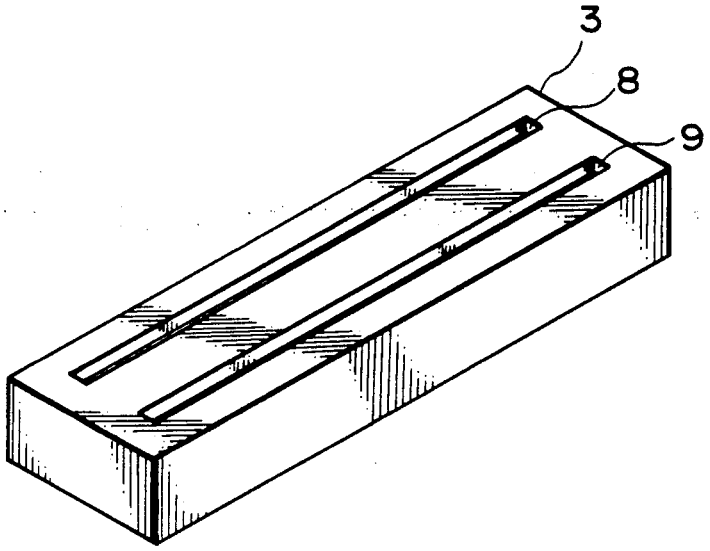
FIG. 2A is a perspective view of a developing head included in the embodiment.
Figure 2B:
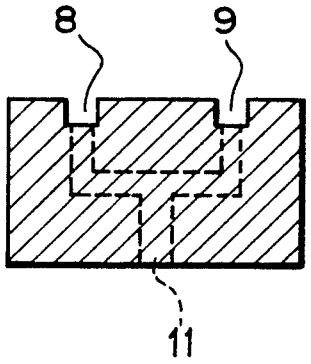
FIG. 2B is a section of the head as seen from the upper rear side as viewed in FIG. 2A.

As shown in FIG. 2A, the developing head 3 forming part of the embodiment has a box-like elongate configuration which extends in the widthwise direction of the recording medium. Two grooves 8 and 9 are formed in the surface of the head 3 which faces a medium transport path, and each extends in the widthwise direction of the medium. As indicated by dashed lines in FIG. 2B, passageways extend from the right ends of the grooves 8 and 9, as viewed in FIG. 2A, to the rear end of the head 3. The passageways communicate the grooves 8 and 9 to a feed conduit 11 which extends from a reservoir 10. The other end of each groove 8 or 9 is communicated to a return conduit 12 by passageways which also extend throughout the head 3. The return conduit 12 extends to the reservoir 10. An electromagnetic valve 13 is disposed in the feed conduit 11 to selectively block or unblock the conduit 11. A pump motor 14 is associated with the return conduit 12 for generating vacuum in the grooves 8 and 9. A control section 15 controls the operations of the entire apparatus and includes means for actuating the valve 13 and means for driving the pump motor 14.

In operation, as the equipment starts on an image forming operation, the pump motor 14 is driven to generate vacuum in the grooves 8 and 9 while the valve 13 is held in a state in which it unblocks the feed conduit 11. The vacuum generated in the grooves 8 and 9 (first vacuum) sucks the recording medium to cause the latter to close the open ends of the grooves 8 and 9. As a result, a liquid developer is fed from the reservoir 10 to the substantially hermetic grooves 8 and 9 via the feed conduit 11. At the same time, the liquid filling the grooves 8 and 9 is returned to the reservoir 10 via the return conduit 12. In this manner, the liquid is circulated through the feed and return paths. Then, the drive roller 4 starts rotating to feed the medium while the recording head 2 starts forming a latent image on the medium. The developing head 3 develops the latent image on the medium as the latter reaches it. Apart from the developing function, the groove 9 downstream of the groove 8 with respect to the direction of medium transport serves to remove excessive part of the liquid deposited on medium by air which flows into the groove 9 via a gap between the surface of the head 3 and the medium due to fine undulations of the medium.

Figure 3:
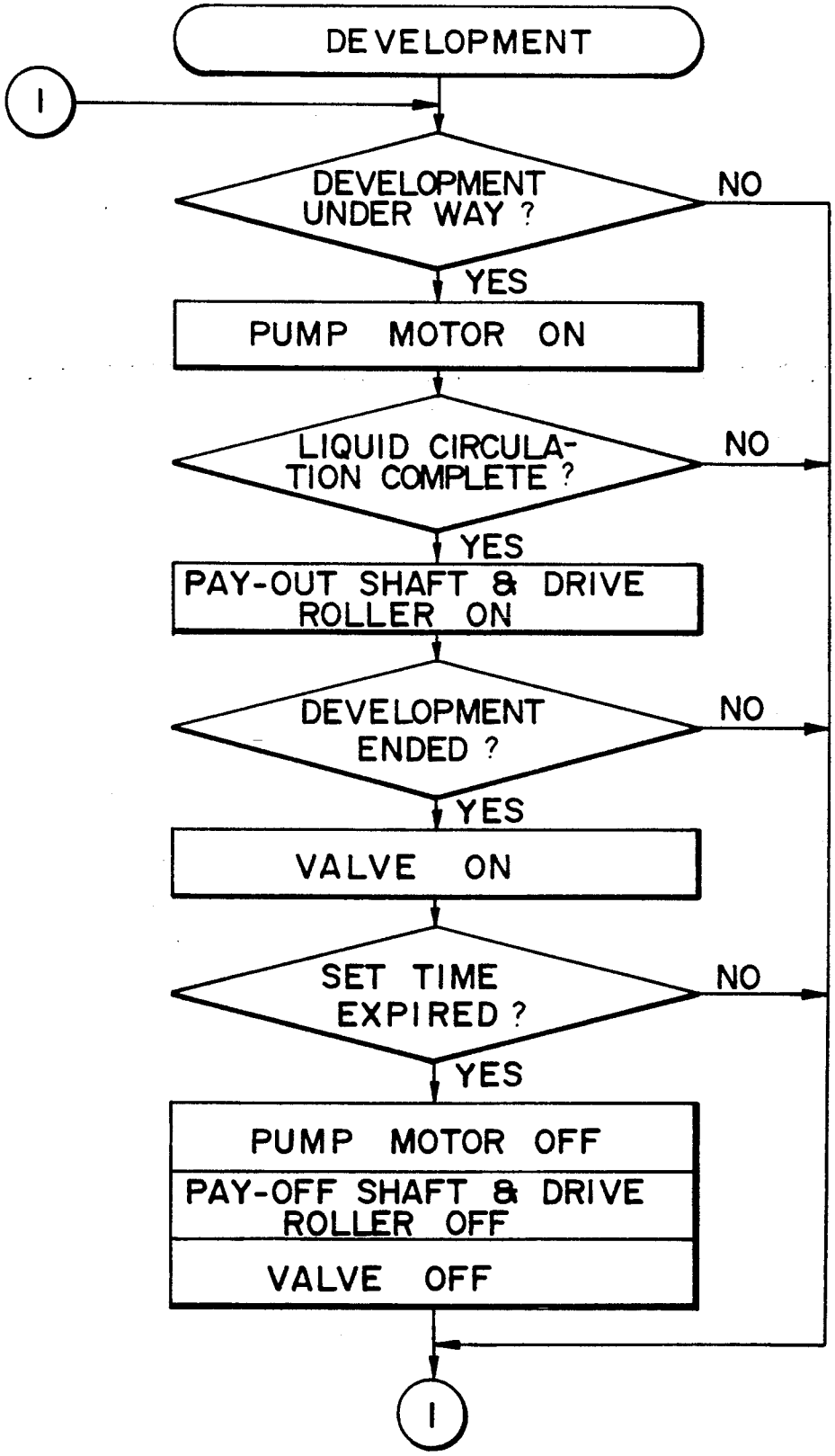
FIG. 3 is a flowchart demonstrating a specific operation of the embodiment.
Figure 5:
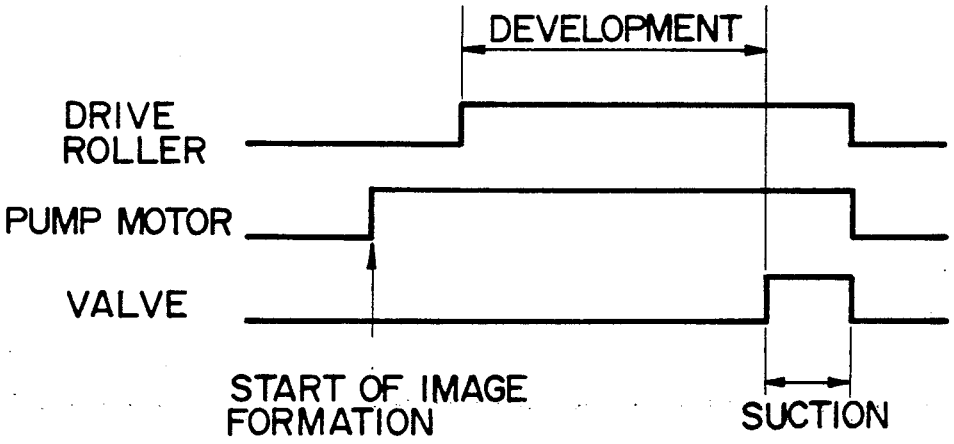
FIG. 5 is a timing chart associated with the flowchart of FIG. 4.

As soon as the trailing edge of the latent image passes the developing head 3, i.e., the latent image is fully developed, the valve 13 is operated to block the feed conduit 11 while the pump motor 14 is continuously driven. Consequently, most of the liquid in the grooves 8 and 9 is rapidly returned to the reservoir 10. Then, the vacuum being generated by the pump motor 14 (second vacuum) is used to suck air into the grooves 8 and 9 via the gap between the head 3 and the medium, thereby sucking the liquid remaining in the grooves 8 and 9 and the medium. Such an operation for sucking the liquid is performed over a predetermined period of time. After the trailing edge of the developed image has moved away from the cutter 6, the cutter 6 is driven to cut the medium. At the same time, the operation of the drive roller 4 and that of the pump motor 14 are stopped, and the valve 13 is operated to unblock the feed conduit 11. The operation described above is demonstrated in a flowchart in FIG. 3 and in a timing chart in FIG. 5. In FIGS. 3 and 5, the state of the valve 13 which blocks the feed conduit 11 and the state which unblocks it are represented by "VALVE ON" and "VALVE OFF", respectively.

For experiments, the recording medium was transported at a rate of 16 millimeters per second and was continuously transported even after the development. The liquid remaining at the corners defined by the upper inner portions of the grooves 8 and 9 smeared the medium over a length of 30 millimeters to 70 millimeters (B, FIG. 7) in the direction of medium transport, i.e., a length from the point of the medium which faces the head 3 when the valve 13 is operated to block the conduit 12 to the point of the same where the smear terminates. For comparison, just after the development, the pump motor 14 was deenergized while the valve 13 was held in the state for unblocking the conduit 11. Then, the liquid of interest was found to smear the medium over a length of 300 millimeters to 400 millimeters (A, FIG. 7) in the direction of medium transport. The embodiment is, therefore, successful in reducing the length of smear on the medium by 270 millimeters to 330 millimeters. It is noteworthy that such a decrease in the length of smear is equivalent to a medium transport time of 16.85 seconds (270/16) to 20.6 seconds. In the case of color development which requires the medium to move back and forth to both sides of the head 3, such a decrease in medium transport time saves the width of reciprocation and, therefore, the developing time.

Figure 4:
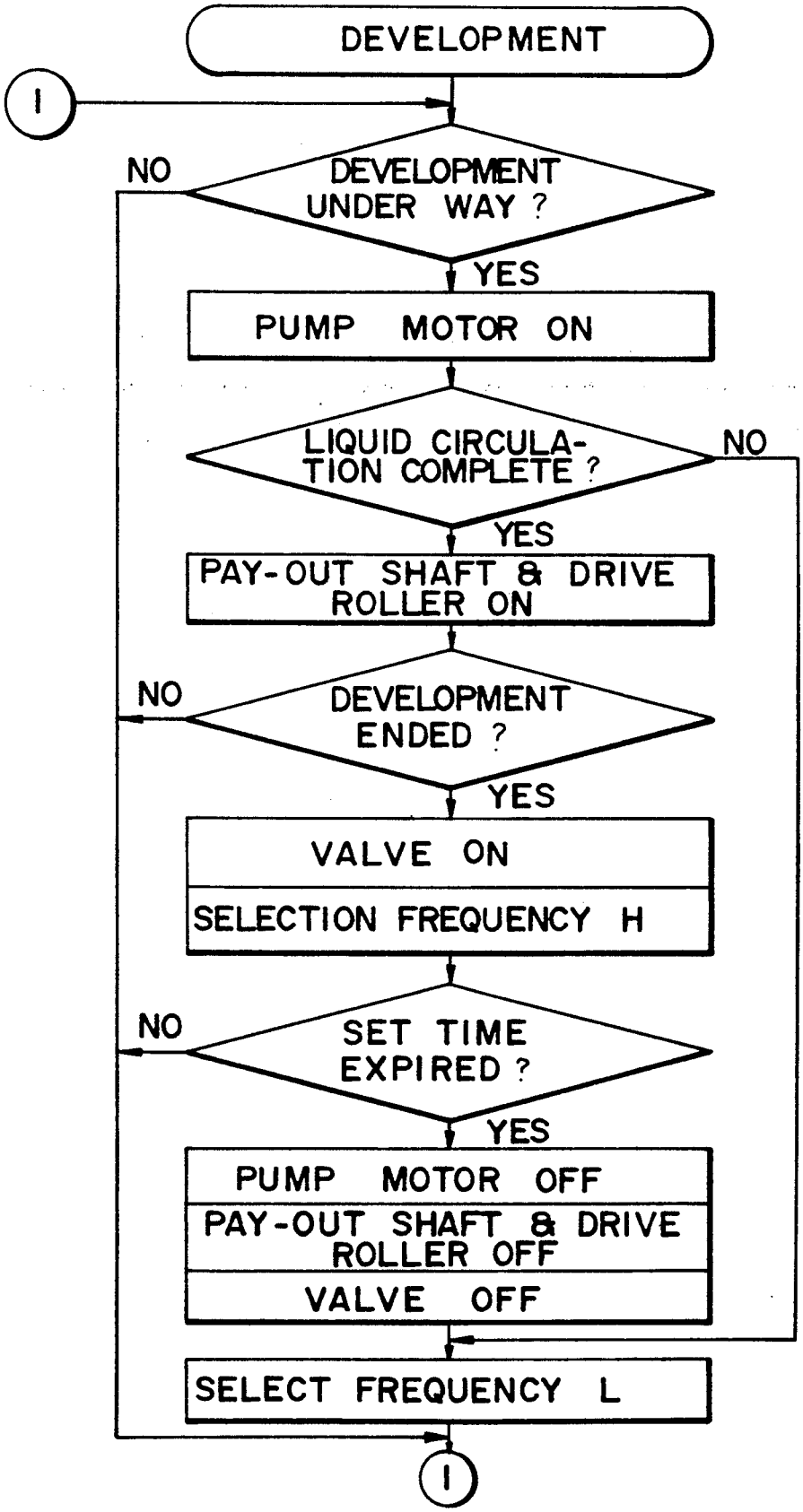
FIG. 4 is a flowchart representative of an alternative embodiment of the present invention.

An alternative embodiment of the present invention will be described with reference to FIG. 4. In the embodiment described above, the pump motor 14 is driven in the same manner in both of the period in which development is under way and the period in which the liquid remaining in the grooves 8 and 9 and medium is sucked. By contrast, the alternative embodiment enhances the pumping function during the sucking period as compared to during the developing period. For this purpose, this embodiment has a frequency converter 16 (indicated by a dotted line in FIG. 1) which changes the frequency of AC being fed to the pump motor 14, i.e., the embodiment feeds AC of higher frequency to the pump motor 14 during the sucking period than during the developing period. As shown in FIG. 4, when the valve 13 is switched over to start on the above-stated suction, the frequency of AC being applied to the pump motor 14 is changed from L assigned to development to H assigned to suction and higher than L. As a result, the rotation of the pump motor 14, i.e., the pumping function is increased to suck the liquid remaining in the grooves 8 and 9 and medium strongly. Thereupon, the pump motor 14 is turned off to end the sucking period, and the frequency is restored to L.

While the embodiments described above each terminates the operation for sucking the remaining liquid at the same time as it ends the transport of the medium, the time for ending the suction may be set independently of the time for ending the medium transport in order to, for example, free the medium from smears due to the suction of the remaining liquid.

To enhance the removal of the excessive liquid from the medium, an exclusive head for the removal of such liquid may be located downstream of the recording head 3 with respect to the direction of medium transport. The number of grooves of the developing head 3 is not limited to two and may be one or more than two. To implement color development, the developing head 3 may be selectively connected to a plurality of reservoirs each containing a liquid developer of particular color and a reservoir containing a cleaning liquid by a valve or similar path switching means. The cleaning liquid will be fed to the head 3 when the developing color is changed. Alternatively, the combination of head 3 and reservoir 10 may be assigned to each of different colors, in which case suitable means for elevating one of the heads 3 to the medium transport path will be used. Further, the embodiments described above are practicable not only with an electrostatic recording system but also with an electrophotographic recording system. Then, the embodiments will eliminate the need for a device heretofore provided for removing excessive liquid independently of a developing apparatus and will reduce the load on a device for cleaning the surface of a photoconductive element.

Figure 8:
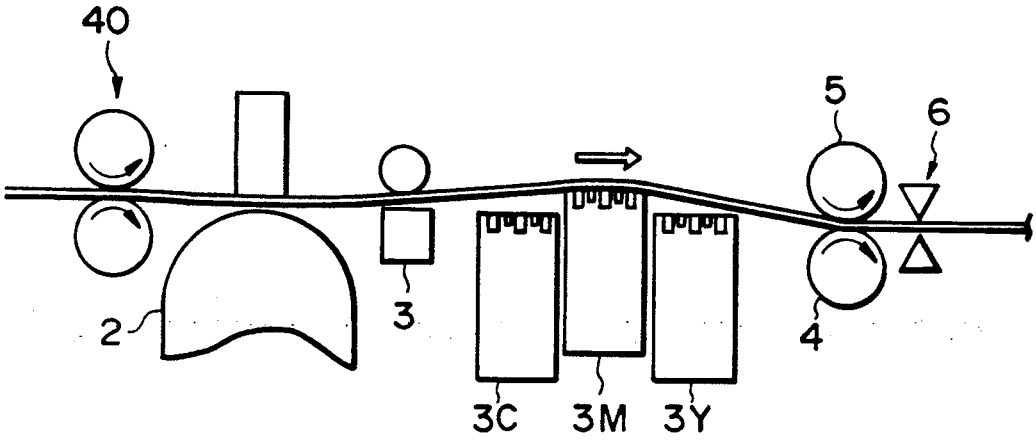
FIG. 8 is a view showing another alternative embodiment of the present invention and applied to electrostatic color image forming equipment.

Referring to FIGS. 8–12, another alternative embodiment of the present invention is shown which is applied to electrostatic color image recording equipment. In the figures, the same or similar parts and elements are designated by like reference numerals, and redundant description will be avoided for simplicity. As shown in FIG. 8, a transport roller pair 40 is disposed on the medium transport path extending from the roll of medium, not shown, to the recording head 2. Developing heads 3C, 3M and 3Y are loaded with a cyan liquid developer, magenta liquid developer and yellow liquid developer, respectively. Elevating means, not shown, supports the developing heads 3C–3Y below the transport path. The elevating means raises only one of the heads 3C–3Y which should develop a latent image to an operative position where it contacts the medium, while maintaining the other heads in inoperative or lowered position thereof. The heads 3C–3Y have an identical structure. means for feeding a liquid developer from a reservoir and means for collecting it to the reservoir are also identical in construction throughout the heads 3C–3Y. The following description will concentrate on the cyan developing head 3C by way of example.

Figure 9:
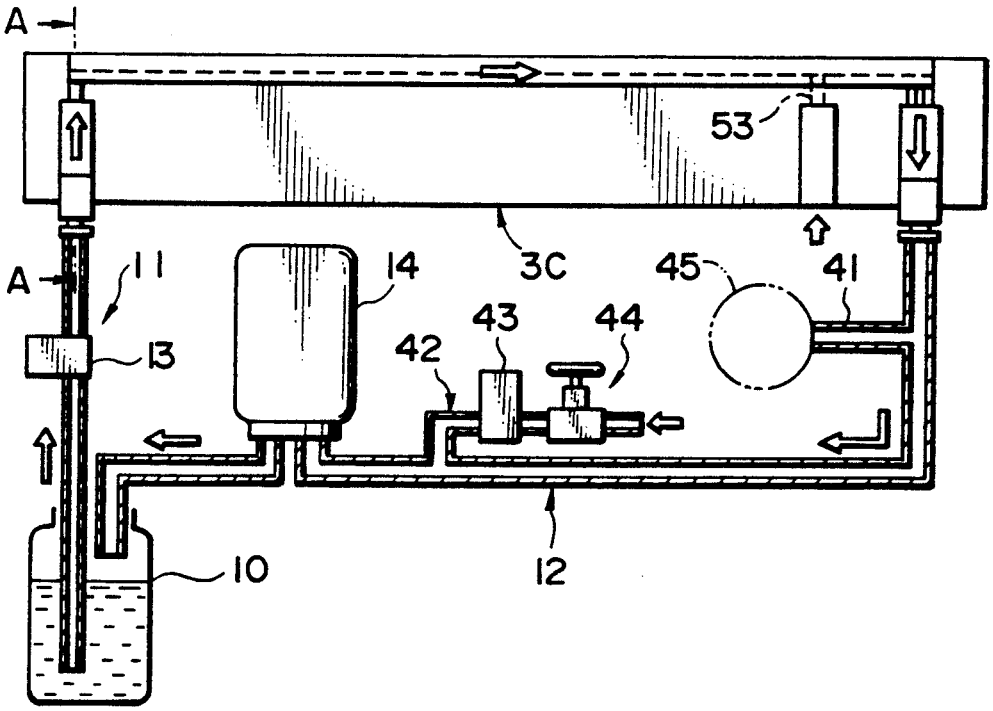
FIG. 9 is a view of a developing apparatus included in the embodiment of FIG. 8 and having a cyan developing head by way of example.
Figure 10:
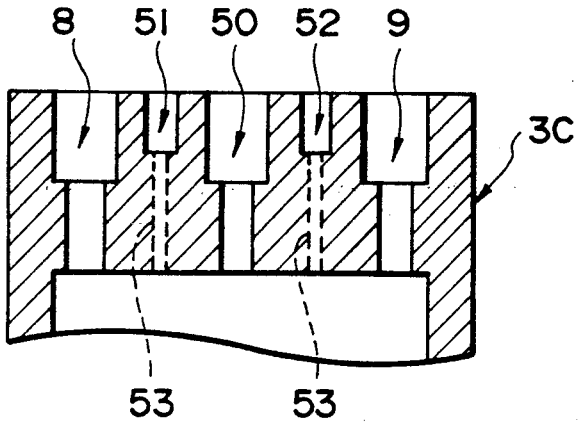
FIG. 10 is a section along line A—A of FIG. 9.

As shown in FIGS. 9 and 10, the head 3C is provided with three liquid grooves 8, 50 and 9 extending in the widthwise direction of the medium, and two air grooves 51 and 52 also extending in the widthwise direction and alternating with the liquid grooves 8, 50 and 9. Again, the liquid grooves 8, 50 and 9 are each communicated at one end thereof to the feed conduit 11 by a passageway which extends to the rear end of the head 3C. The electromagnetic valve 13 is disposed in the conduit 11. The other end of each liquid groove 8, 50 or 9 is communicated to the return conduit 12 by a similar passageway, the pump motor 14 being associated with the conduit 12. On the other hand, the air grooves 51 and 52 are each communicated to the atmosphere at the side thereof where the return conduit 12 is connected to the head 3C, by a passageway 53 extending throughout the head 3C. The air grooves 51 and 52 cause air to flow in via the gap between the part of the surface of the head 8 which is located upstream of the upstream liquid groove 8 and the side of the medium that faces the head 3C, and the gap between the part of the surface of the head 8 which is located downstream of the downstream liquid groove 9 and the above-mentioned side of the medium. In addition, the air grooves 51 and 52 set up the inflow of air via the gaps between the surface portions of the head 3C where the air grooves 51 and 52 adjoin the liquid grooves 8, 50 and 9 and the side of the medium that faces the head 3C. The air grooves 51 and 52, therefore, enhance the function of removing the liquid remaining at the corner portions of the liquid grooves 8, 50 and 9. The return conduit 12 is provided with branch conduits 41 and 42 between the head 3C and the pump motor 14. The branch conduit 41 is provided with a pressure gauge 45 while the branch 42 is communicated to the atmosphere via an electromagnetic valve 43 and a vacuum control valve 44. The vacuum control valve 44 is operable to adjust the vacuum in the liquid grooves 8, 50 and 9 to an adequate level, for the following reasons. Namely, when the vacuum in the grooves 8, 50 and 9 is excessively high, the air sucked into the grooves 8, 50 and 9 is apt to form bubbles in the liquid to thereby produce a minute pattern of white stripes on a printing. Conversely, when the vacuum is excessively low, the flow rate of liquid in the grooves 8, 50 and 9 is apt to become low to render the density distribution of a printing irregular. Further, the vacuum in the grooves 8, 50 and 9 depends on the smoothness of the medium used. The valve 43 communicates the vacuum control valve 44 to the return conduit 12 when turned off or interrupts the communication when turned on. Specifically, when the liquid should be returned from the liquid grooves 8, 50 and 9 after the development, the valve 43 is turned on to intercept air from the branch conduit 42 and thereby intensifies the liquid collecting force.

In operation, the equipment awaits the start of a recording operation while nipping the end of the recording medium between the drive roller 4 and pinch roller 5. In this condition, all the developing heads 3C, 3M and 3Y are held in their inoperative or lowered positions spaced apart from the medium transport path. After the equipment has processed data fed sent from a data processing unit, not shown, it starts on a recording operation. At this time, the developing head 3C, for example, has been raised to the operative position where the surface thereof adjoins the medium transport path. Then, the cyan liquid developer is fed from the exclusive reservoir 10 to the grooves 8, 50 and 9 of the head 3C. While the cyan liquid is circulated through the head 3C and reservoir 10, the drive roller 4 and other rollers are rotated to transport the medium. The recording head 2 electrostatically forms a latent image on the medium, and then the developing head 3C develops it. On completing the latent image in cyan, the head 3C is lowered to the inoperative position thereof. Then, the drive roller 4 and other rollers are reversed to return the image portion of the medium to the recording head 2. Thereafter, the procedure described above in relation to the cyan image component is repeated with a magenta and a yellow image component, completing a color image. After the development in the yellow liquid developer, the medium having passed the head 3Y is continuously moved forward. Just before the leading edge of the color image passes the cutter 6, the cutter 6 is driven to cut off the leading or excessive part of the medium. Just after the trailing edge of the color image has moved away from the cutter 6, the cutter 6 is again driven to cut the medium. Subsequently, the head 3Y is lowered to the inoperative position thereof. The drive roller 4 is continuously rotated to drive the cut length of medium, or sheet, to the outside of the equipment.

While development using the heads 3C–3Y is under way, both the valves 13 and 43 are turned off (unblocked) and the pump motor 14 is turned on. Hence, the liquid of particular color is fed from the reservoir 10 to the grooves 8, 50 and 9 of the head 3 via the feed conduit 11. The liquid joined in the development is returned from the grooves 8, 50 and 9 to the reservoir 10 via the return conduit 12 and pump motor 14. During this period of time, the medium is sucked to the open ends of the grooves 8, 50 and 9 to generate vacuum therein. The vacuum control valve 44 is operable to adjust the amount of incoming air, i.e., the vacuum in the grooves 8, 50 and 9, so that the transport of the medium and the development may be adequately effected. Every time the development in one color completes, i.e., every time the developed image moves away from the associated development head, the valves 13 and 43 are turned on (blocked) over a predetermined period of time with the drive roller 4 and pump motor 14 maintained operative. As a result, the vacuum in the grooves 8, 50 and 9 is intensified to collect the liquid remaining at the corners and interior of the grooves 8, 50 and 9. In addition, when the supply of liquid from the developing head to the medium is terminated, i.e., when the pump motor 14 is deenergized with the developing head held in the operative position or when the developing head is lowered with the pump motor 14 deenergized, excessive liquid is prevented from remaining on the medium.

Assume that the recording medium has jammed the transport path while development is under way. Then, if the drive roller 4 and other rollers and the pump motor 14 are simply deactivated, the above-stated procedure for preventing the liquid from remaining on the medium after development is not performed, causing the liquid to remain in the grooves 8, 50 and 9. This part of the liquid would deposit in a great amount on the medium and would thereby smear the transport system including the drive roller 4 as well as the operator's hands. Especially, when the developing head contacting the medium is lowered away from the head, a great amount of liquid is transferred from the head to the medium. The illustrative embodiment is provided with an implementation for preventing an amount of liquid great enough to smear the transport system from depositing on the medium at the moment when the developing head is released from the medium.

Figure 11:
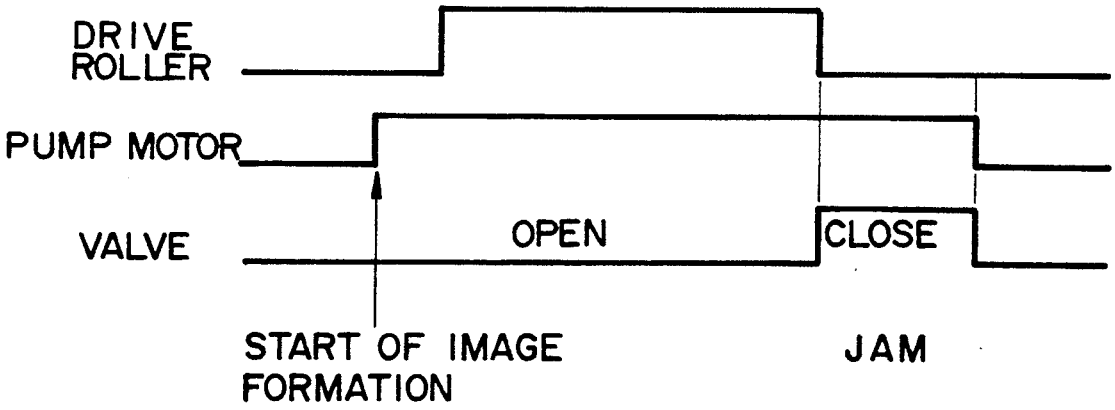
FIG. 11 is a timing chart demonstrating a specific operation of the equipment shown in FIG. 8.
Figure 12:
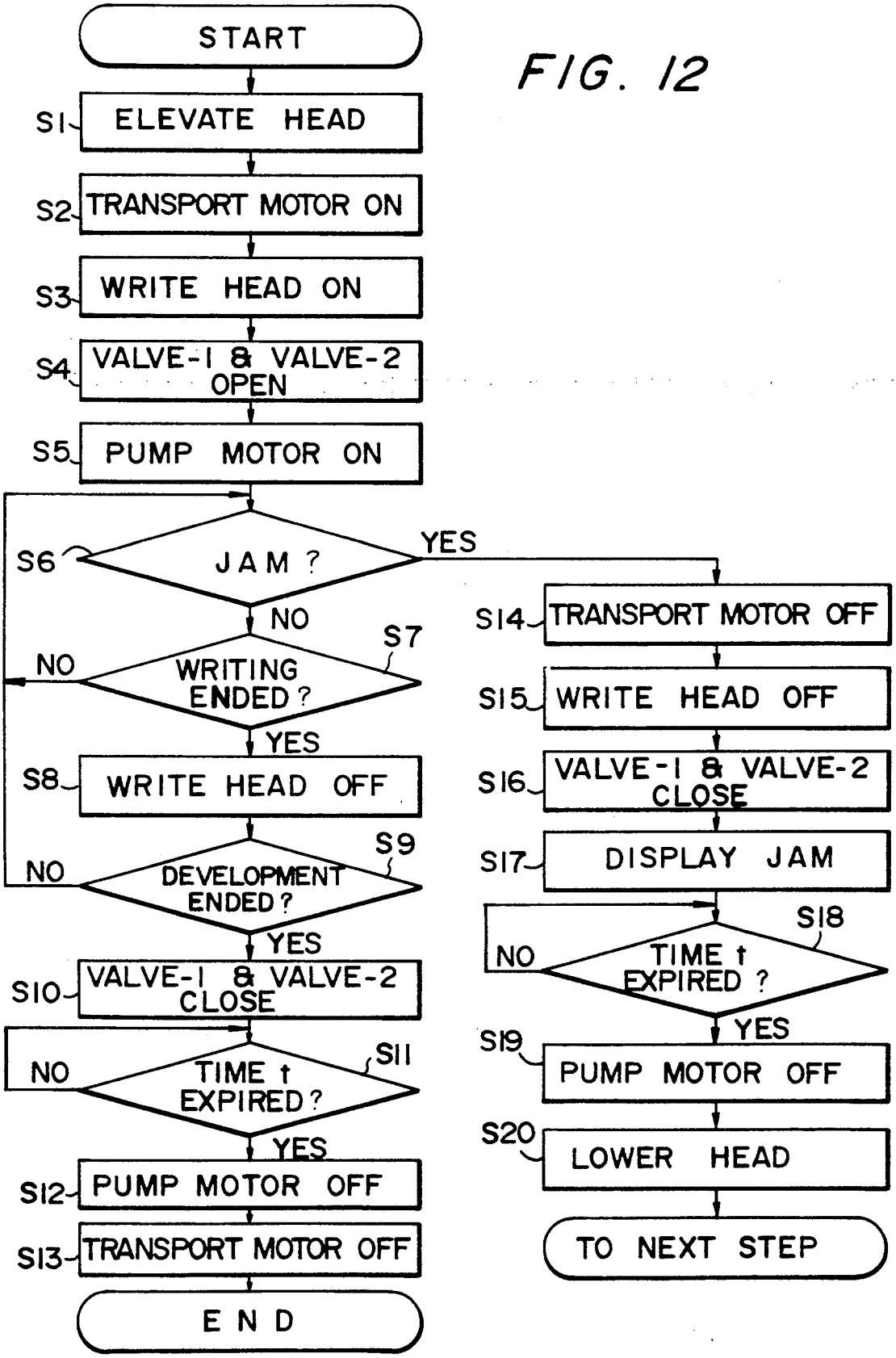
FIG. 12 is flowchart associated with FIG. 11.

Specifically, as shown in FIGS. 11 and 12, so long as the transport path is not jammed by the medium, steps S1 to S13 are executed to form an image, as stated above. It is to be noted that the flowchart shown in FIG. 12 is representative of a procedure for forming an image in a single color by a single developing head. When the medium jams the transport path, jam processing beginning at a step S6 and ending at a step S20 is executed. First, a transport motor for driving the drive roller 4 and other rollers is turned off to stop feeding the medium (S14). The recording head (write head) 2 is turned off (S15). The electromagnetic valves 13 and 43 are closed (close valve-1 and valve-2) (S16). As a result, the supply of liquid from the reservoir 10 to the developing head is interrupted, and the vacuum in the head is intensified to return the liquid from the grooves 8, 50 and 9 to the reservoir 10. Such a jam is displayed on an operation board (S17). Then, the program waits a predetermined period of time t (S18) which is necessary for the liquid to be collected from the grooves 8, 50 and 9 and determined by experiments in advance. On the elapse of the time t, the pump motor 14 is turned off (S19). Finally, the developing head is lowered to the inoperative position (S20).

Preferably, the sequence of steps described above is executed not only when a jam occurs but also when the transport of the medium should be interrupted for one reason or another. For example, the medium has to be stopped when the cover of the apparatus is opened during operation, when an error occurs in the transport and drive systems or in a signal system, or when the operator enters an interrupt command on the operation board. When an error occurs in the signal system or when the operator enters an interrupt command, it is likely that part of the medium undergoing developing is directly driven out of the equipment. Then, although an amount of liquid great enough to smear, for example, the transport system may be prevented from remaining on the medium by the above procedure, the part of the medium where some liquid remains is apt to be used to form an image when the recording operation is resumed afterwards. To eliminate such an occurrence, it is preferable that the above-mentioned part of the medium be fed by the drive roller 4 and then cut off by the cutter 6.

In summary, the present invention provides a developing apparatus which causes a greater amount of air to flow into a liquid groove or grooves after development than during development, thereby removing a liquid developer from a corner defined by the upper inner portion of each groove and a recording medium rapidly. Hence, even when the medium is continuously transported, the smear (A, FIG. 7) of the medium due to the developer remaining at the above-mentioned corner is far smaller than the conventional smear (B, FIG. 7) with respect to the length in the direction of medium transport. In the event of color development using a plurality of developing heads each being supplied with a liquid developer of particular color, the heads which are caused to face a medium transport path one at a time do not have to be moved back and forth over an additional width since the level of the smear on the medium is short, as stated above. This is successful in reducing the color developing time. Even when a developing head should be moved between an operative position facing the transport path and an inoperative position spaced apart from the transport path, the liquid remaining at the corner is removed with no regard to the operable mode of the apparatus, i.e., a black-and-white mode or a color mode. This prevents the developing head from smearing the medium or the transporting means when moved to the operative position again. When the movement of the medium should be interrupted while development is under way, vacuum control means continuously drives vacuum generating means over a predetermined period of time after valve control means has blocked the liquid feed path, thereby removing the remaining liquid by suction. As a result, a great amount of liquid is prevented from remaining on the medium when the medium is brought to a stop during development and, therefore, from smearing the transport system or the operator's hands and clothes.

Various modifications will become possible for those skilled in the art after receiving the teachings of the present disclosure without departing from the scope thereof.

What is claimed is:

1. A developing apparatus for developing an image formed on a recording medium, comprising:

means for transporting a medium along a medium transport path;

a developing head having a groove facing a medium being transported along the medium transport path, said groove extending in a widthwise direction to said medium;

suction means for flowing a liquid developer into said groove so that an image on the medium is developed; and means for causing a suction in said groove to be greater after the medium is developed than during development.

2. A developing apparatus for developing a latent image formed on a recording medium by a liquid developer, comprising:

a developing head having a groove formed in a surface thereof which faces a medium transport path, the groove extending in the widthwise direction of said medium;

a reservoir storing said developer liquid;

feed path means for feeding said liquid developer from said reservoir to said groove;

return path means for returning said liquid developer from said groove to said reservoir;

vacuum generating means disposed in said return path means for generating vacuum in said groove;

a valve for selectively blocking or unblocking said feed path means;

valve control means for controlling said valve; and vacuum control means for generating a first vacuum in said groove while liquid developer is fed from said reservoir to said groove and for generating a second vacuum in said groove higher than said first vacuum over a predetermined period of time after said valve control means has operated said valve to block said feed path means.

3. The developing apparatus of claim 2 wherein said vacuum control means further comprises means for adjusting a level of said first vacuum.

4. The developing apparatus of claim 3, wherein said means for adjusting a level of said first vacuum comprises a vacuum control valve in said return path means between said groove and said vacuum generating means so as to allow air into said return path means, and wherein said means for generating a second vacuum comprises means for closing said vacuum control valve.

5. The developing apparatus of claim 2, wherein said vacuum control means further comprises means for generating said second vacuum when the recording medium has jammed.

6. The developing apparatus of claim 2, wherein said vacuum generating means comprises a vacuum pump having an AC pump motor, and a frequency generator supplying at least two AC frequencies to said pump motor so as to generate said first and second vacuums.

7. The developing apparatus of claim 2, wherein said vacuum control means comprises means to generate said second vacuum by controlling said valve control means to cause said valve to block said feed path means.

* * * * *

UNITED STATES PATENT AND TRADEMARK OFFICE

CERTIFICATE OF CORRECTION

PATENT NO. : 5,202,534

DATED : April 13, 1993

INVENTOR(S) : YOSHIYUMI TAMIYA ET AL.

It is certified that error appears in the above-identified patent and that said Letters Patent is hereby corrected as shown below:

Title page, item 75, the First Named Inventor's name should be YOSHIYUMI TAMIYA.

Signed and Sealed this

Fourth Day of January, 1994

*Attest:*

*Attesting Officer*

Bruce Lehman

BRUCE LEHMAN

*Commissioner of Patents and Trademarks*